US006892645B2

(12) United States Patent
Nodine

(10) Patent No.: US 6,892,645 B2
(45) Date of Patent: May 17, 2005

(54) MULTIPLE INDEPENDENT PENETRATING ELECTRODE NON-ELECTRIC INITIATOR TIP

(76) Inventor: John P. Nodine, 176 Cremsey Cove Rd., Leicester, NC (US) 28748

( * ) Notice: Subject to any disclaimer, the term of this patent is extended or adjusted under 35 U.S.C. 154(b) by 115 days.

(21) Appl. No.: 10/402,547

(22) Filed: Mar. 28, 2003

(65) Prior Publication Data

US 2004/0025735 A1 Feb. 12, 2004

Related U.S. Application Data

(60) Provisional application No. 60/368,812, filed on Mar. 29, 2002.

(51) Int. Cl.[7] ..... C06C 5/06

(52) U.S. Cl. ..... 102/275.11; 102/275.12; 102/202.8

(58) Field of Search ..... 102/222, 202.1, 102/275.11, 275.12, 275, 202.8, 202.14

(56) References Cited

U.S. PATENT DOCUMENTS 5,341,742 A * 8/1994 Alford et al. ..... 102/202.8
6,196,131 B1 * 3/2001 Yanda et al. ..... 102/275.11

FOREIGN PATENT DOCUMENTS

GB 2056633 A * 3/1981 ..... C06C/7/00
GB 2123217 A * 1/1984 ..... H01F/23/00

OTHER PUBLICATIONS

WO 93/23718, Shann et al., International Application Publication, Nov. 25, 1993.*

Blasting Machines & Initiators, AccurateBlasting.com, Apr. 12, 2003, available @http://www.accurateblasting.com/accessories/blast–machines.html.*

Wizard Lightning STI, Wizard Devices, Inc. May 5, 2002, available @http://web.archive.org/web/20021013012731/http://www.wizard–devices.com/lightning.shtml.*

Reusable Shock Tube Initiator STI–8, risi, available @http://www.risi–usa.com/0products/4acc/page33.html.*

* cited by examiner

*Primary Examiner*—Michael Carone
*Assistant Examiner*—Daniel Lawson Greene Jr.
(74) *Attorney, Agent, or Firm*—Technoprop Colton LLC

(57) ABSTRACT

Multiple independent penetrating electrode non-electric tips in which the electrodes are separated in a non-coaxial arrangement so as to generate a spark gap internal to the non-electric shock tube, with the electrodes being brought together inside of the shock tube at a very precise distance, improving longevity by eliminating ablation of the insulating material between the inner and outer electrodes, reducing electrical shorting of the electrodes, and providing more consistent and reliable ignition of shock tubes.

61 Claims, 8 Drawing Sheets

MULTIPLE INDEPENDENT PENETRATING ELECTRODE NON-ELECTRIC INITIATOR TIP

STATEMENT OF RELATED APPLICATIONS

This patent application claims priority on U.S. Provisional Patent Application No. 60/368,812, having a filing date of 29 Mar. 2002.

BACKGROUND OF THE INVENTION

1. Field of Invention

The invention generally relates to the blasting industry and the explosive ordnance disposal (EOD) industry as a reliable initiation device for non-electric shock tube, which is achieved by electronic means, and more specifically relates to the field of initiator tip devices for igniting a shock tube.

2. Prior Art

FIGS. 1–3 illustrate a standard a standard coaxial initiator tip device assembly showing an outer electrode tube 1 with insulator material 2 such as Teflon® and a center electrode 3, thus comprising a coaxial electrode assembly. The precise gap is achieved by regulating the distance between the center electrode 3 and the outer electrode tube 1. High voltage with a potential difference of between 1500~3000 volts is applied to the two electrodes 1, 3, which will produce a hot plasma arc and ignite the non-electric shock tube 4.

Standard coaxial initiator tip devices shown such as that shown in FIGS. 1–3 are known in the art and are in common usage. However, the existing method of a coaxial spark gap suffers from disadvantages such as excess ablation of the insulating material between the inner and outer electrodes, thus leading to electrical shorting of the electrodes and hence a failure to provide enough energy to ignite the shock tube. As a result, the standard coaxial initiator tip devices are suitable only for a limited number of uses, with each successive use generally being less effective that the prior use.

While the prior art proceeds to disclose an array of initiator tip devices for igniting shock tubes, the prior art devices generally do not provide a consistent and reliable spark throughout the life of the device. What is needed but not found in the prior art is a device for the initiation or ignition of shock tubes that significantly improves the consistency and reliability of spark generation throughout a longer lifetime.

It is to these needs and others that the present invention is directed. By utilizing a non-coaxial design contained in a compact casing, and utilizing simple mechanical means for inserting the electrodes into the shock tube for ignition, the present invention has distinct advantages over the known prior art.

BRIEF SUMMARY OF THE INVENTION

The function of the multiple independent penetrating electrode non-electric initiator tip of the present invention is for the purpose of igniting the small quantity of explosives contained inside the plastic tubing, such as RDX or PETN, of a shock tube. The combination of the explosive material combined with the plastic tubing forms a low velocity shock tube, as known by those practiced in the art as a non-electric shock tube. A non-electric shock tube is used to initiate a blasting cap's primary explosive charge, which in turn ignites the base charge. Non-electric blasting caps rely on the ignition of the shock tubing attached to them as a means of ignition.

Briefly, the multiple independent penetrating electrode non-electric tip of the present invention comprises at least two electrodes that are separated from each other in a non-coaxial arrangement. The separation generates a spark gap internal to the non-electric shock tube, with the electrodes being brought together inside of the shock tube at a very precise distance. Two non-coaxial electrodes are inserted into a shock tube at different locations so as to create the spark gap between the electrodes such that when the electric charge is delivered a spark is created within the spark gap thus igniting the shock tube. This construction improves the longevity of the device when compared to other devices by eliminating ablation of the insulating material between the inner and outer electrodes of other devices, reduces electrical shorting of the electrodes, and provides more consistent and reliable ignition of shock tubes.

The present invention further comprises a structure containing the electrodes and allowing for a shock tube to be inserted and ignited. At a minimum, the structure containing the electrodes should have a place where the shock tube can be inserted into the structure, a means for inserting a first electrode into the shock tube, a means for inserting a second electrode into the shock tube, and a means for providing an electric current across the electrodes to create the ignition spark.

These features, and other features and advantages of the present invention will become more apparent to those of ordinary skill in the art when the following detailed description of the preferred embodiments is read in conjunction with the appended figures.

DETAILED DESCRIPTION OF THE PREFERRED EMBODIMENTS

The design of the multiple independent electrode non-electric initiator of the present invention separates the electrodes from each other in a non-coaxial arrangement so as to generate a spark gap between the electrodes and also internal to the non-electric shock tube. The electrodes are brought together inside of the shock tube at a very precise distance apart from each other. This provides improved longevity compared to the prior art devices as the prior art method of using a coaxial spark gap suffers from ablation of the insulating material between the inner and outer electrodes and thus leads to electrical shorting of the electrodes and hence a failure to provide enough energy to ignite the shock tube.

The ignition of the shock tube is greatly enhanced by introducing the electrodes independently, internal to the shock tube, as opposed to placing the electrodes external to the shock tube. While it is possible to provide ignition with external electrodes, relative to the shock tube, the energy available to ignite the explosive within the shock tube is diminished. Therefore, it is a preferred method of this embodiment to generate the electric spark, or plasma arc, internal to the shock tube with multiple independent penetrating electrodes.

The present invention can be configured in many equivalent manners having the same end result. Illustrative embodiments of several preferred configurations are shown in FIGS. 4–9. However, the invention is not limited to these illustrative embodiments, which are presented to provide a basic understanding of the invention.

Figure 1:
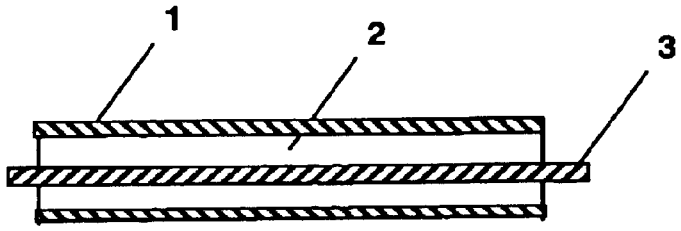
FIG. 1 is a sectional side view of a prior art coaxial initiator tip assembly.
Figure 2:
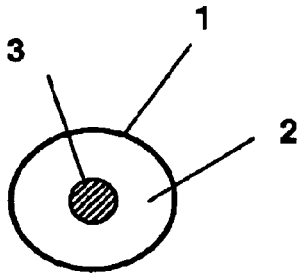
FIG. 2 is an end view of the prior art coaxial initiator tip assembly shown in FIG. 1.
Figure 3:
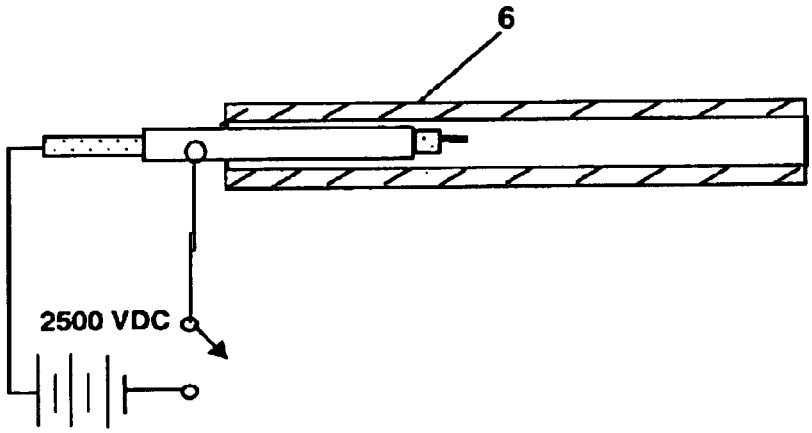
FIG. 3 is a sectional side view of a prior art coaxial initiator tip assembly tip shown with a power supply and inserted into a shock tube.
Figure 4:
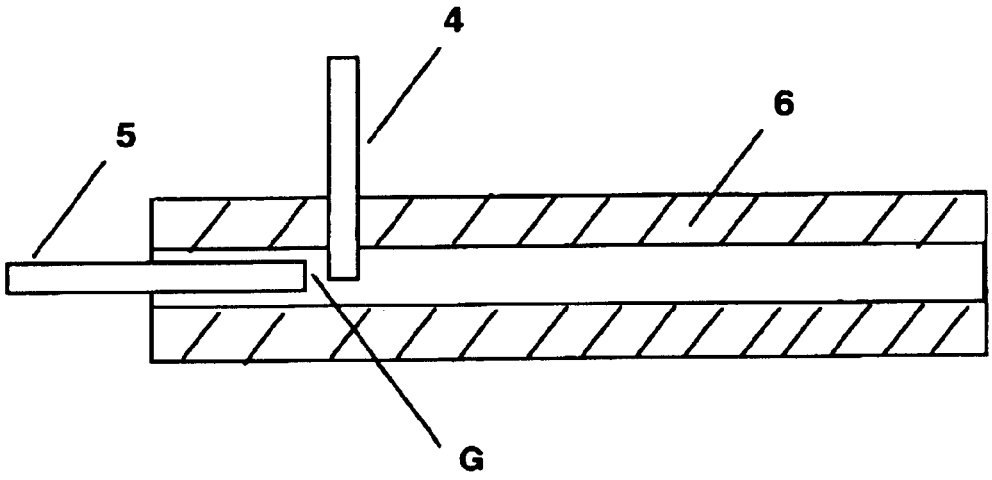
FIG. 4 is a schematic sectional side view of a first embodiment of a multiple independent penetrating electrode non-electric initiator tip according to the present invention in a perpendicular electrode arrangement.

A first preferred embodiment of the invention is shown schematically in FIG. 4. The embodiment shown in FIG. 4 employs two internal electrodes 4, 5 that are inserted into shock tube 6 perpendicular to each other. Spark gap G formed between electrodes 4, 5 internal to shock tube 6 is an example of a multiple independent penetrating electrode non-electric shock tube initiator in a perpendicular electrode arrangement.

Figure 5:
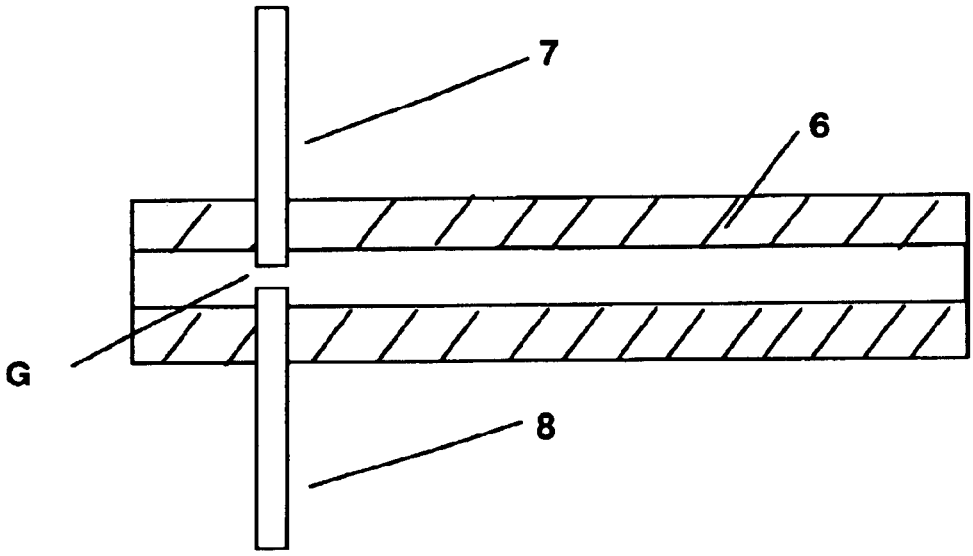
FIG. 5 is a schematic sectional side view of a second embodiment of a multiple independent penetrating electrode non-electric initiator tip according to the present invention in an opposing electrode arrangement.

A second preferred embodiment of the invention is shown schematically in FIG. 5. The embodiment shown in FIG. 5 employs two internal electrodes 7, 8 that are inserted into shock tube 6 from opposing sides. Spark gap G formed between electrodes 7, 8 internal to shock tube 6 is an example of a multiple independent penetrating electrode non-electric shock tube initiator in an opposing electrode arrangement.

Figure 6:
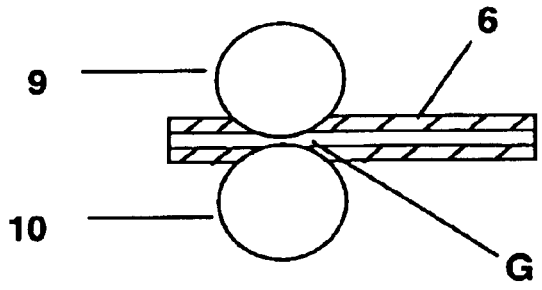
FIG. 6 is a schematic sectional top view of a third embodiment of a multiple independent penetrating electrode non-electric initiator tip according to the present invention in an opposing cutting wheel arrangement.

A third preferred embodiment of the invention is shown schematically in FIG. 6. The embodiment shown in FIG. 6 employs two opposing razor wheels 9, 10. As shock tube 6 is pushed into the razor wheels 9, 10, shock tube 6 is displaced by the cutting or slicing action of razor wheels 9, 10 such that razor wheels 9, 10 form a fixed distance spark gap G between razor wheels 9, 10. FIG. 6 is a second example of a multiple independent penetrating electrode non-electric shock tube initiator in an opposing electrode arrangement.

Figure 7:
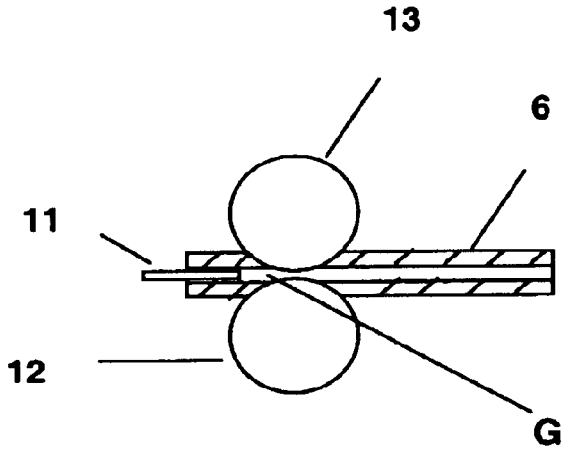
FIG. 7 is a schematic sectional top view of a fourth embodiment of a multiple independent penetrating electrode non-electric initiator tip according to the present invention in an opposing cutting wheel with a tertiary electrode arrangement.

A fourth preferred embodiment of the invention is shown schematically in FIG. 7. The embodiment shown in FIG. 7 combines the two opposing razor wheel 12, 13 arrangement shown in FIG. 6 with a tertiary electrode 11. The embodiment shown in FIG. 7 is both an insulation displacement technique using razor wheels 12 and 13 to displace the shock tube 6 and a tertiary electrode 11 that forms a fixed gap G with the razor wheels 12, 13 thus forming a third example of a multiple independent penetrating electrode non-electric shock tube initiator in an opposing electrode arrangement.

Figure 8:
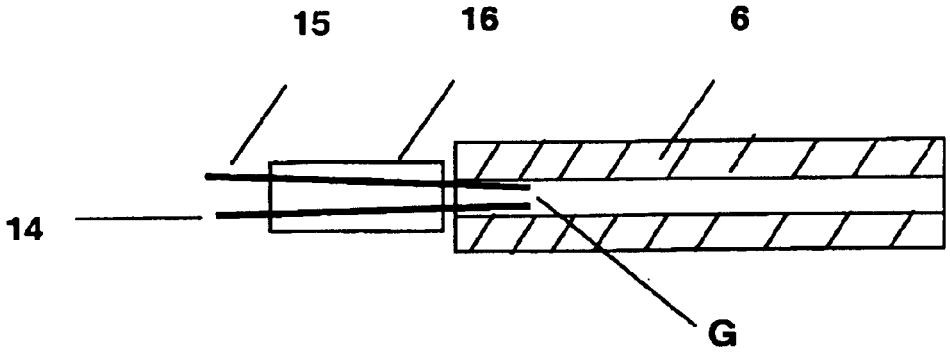
FIG. 8 is a schematic sectional side view of a fifth embodiment of a multiple independent penetrating electrode non-electric initiator tip according to the present invention in an arrangement having two independent penetrating electrodes mounted in an insulating block.

A fifth preferred embodiment of the invention is shown schematically in FIG. 8. The embodiment shown in FIG. 8 comprises two independent electrodes 14, 15 that are maintained at a fixed gap G by an insulating block 16. Insulating block 16 can be made of a material such as, but not limited to, polymer, glass, ceramic, or composite materials, as illustrative examples. The electrodes 14, 15 and the insulating block 16 are slid inside shock tube 6, forming a multiple independent penetrating electrode non-electric shock tube initiator assembly.

Figure 9:
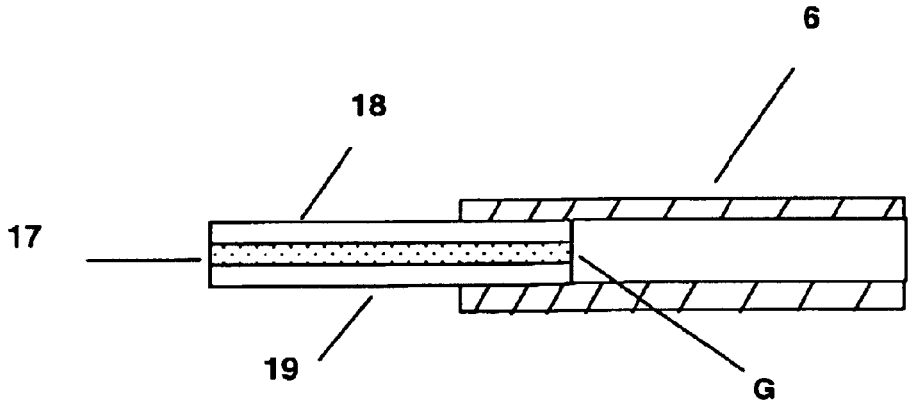
FIG. 9 is a schematic sectional side view of a sixth embodiment of a multiple independent penetrating electrode non-electric initiator tip according to the present invention in an arrangement having two independent penetrating electrodes mounted by plasma deposition on a ceramic rod.

A sixth preferred embodiment of the invention is shown schematically in FIG. 9. The embodiment shown in FIG. 9 also comprises two independent electrodes 18, 19 that are plasma coated to a ceramic or other insulative rod 17. The ceramic rod 17 creates spark gap G between electrodes 18, 19. The electrodes 18, 19 and the ceramic rod 17 are slid inside shock tube 6, forming a multiple independent penetrating electrode non-electric shock tube initiator assembly.

Figure 10:
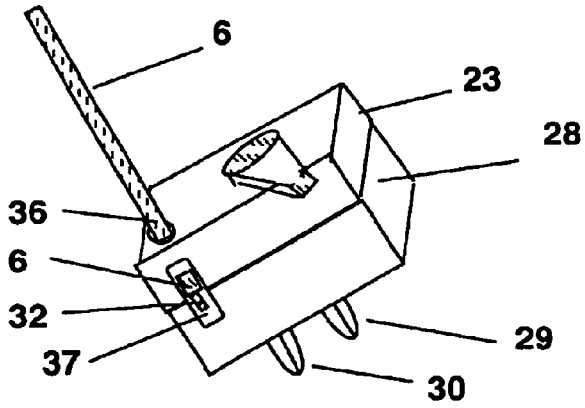
FIG. 10 is an isometric view of a preferred embodiment of the present invention.

Each of the embodiments shown in FIGS. 4–9 can be contained in an independent electrode holder structure 50, such as that shown in FIG. 10. For illustrative purposes, the embodiment of FIG. 4 will be used as the example embodiment in the following disclosure of a preferred structure 50. However, those practiced in the art will be able to modify the structure 50 to contain any of the preferred embodiments, and their equivalents, without undue experimentation.

FIG. 10 is an isometric view of a preferred embodiment of the multiple independent penetrating electrode non-electric shock tube initiator assembly of the present invention in a usable casing. Generally speaking, structure 50 comprises upper housing 23 and lower housing 28 that together form the casing containing electrodes 4, 5, 7, 8, 9, 10, 11, 12, 14, 15, 18, 19. For ease of disclosure, the invention will be explained using two electrodes, namely moving electrode 38 and adjustable electrode 32, as shown in more detail in FIG. 14. Shock tube 6 is inserted into structure 50 through insertion hole 36 and contacted to or impaled upon adjustable electrode 32. This can be seen through viewing/exhaust port 37. As discussed in more detail in connection with FIG. 18, adjustable electrode 32 is inserted into the end of shock tube 6.

Figure 11:
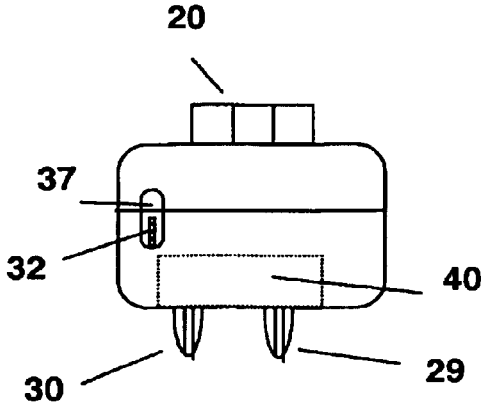
FIG. 11 is a side view of the embodiment of the present invention shown in FIG. 10.

FIG. 11 is an isometric side view of structure 50 showing in particular viewing/exhaust port 37, adjustable electrode 32, and electrical connections 29, 30. High voltage shroud 40, which is recessed, also indicated. Structure 50 is connected to a source of electricity (not shown) via connections 29, 30, which provide the necessary electricity to electrodes 32, 38 to cause the spark.

Figure 12:
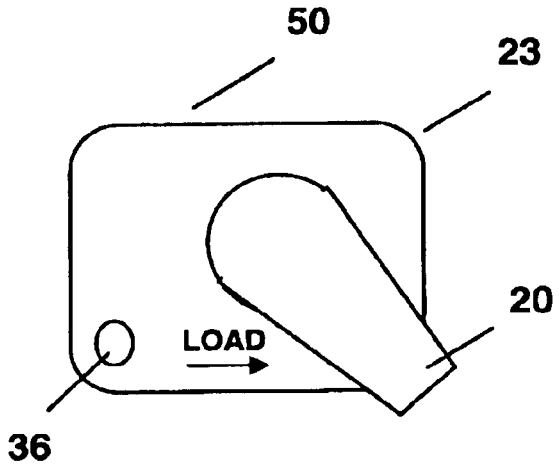
FIG. 12 is a top view of the embodiment of the present invention shown in FIG. 10 in the load position.
Figure 13:
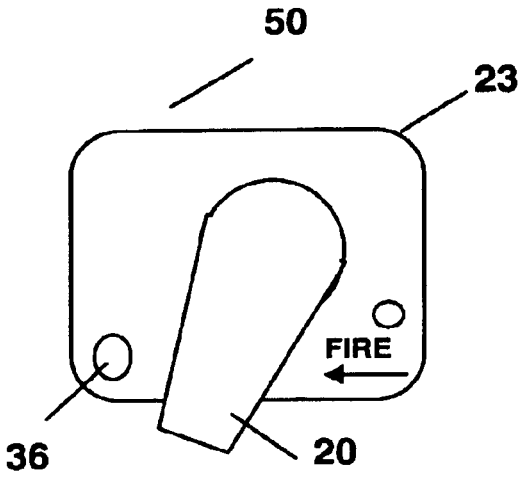
FIG. 13 is a top view of the embodiment of the present invention shown in FIG. 10 in the fire position.

FIG. 12 is a top view of structure 50 with piercing assembly control arm 20 in the load position. FIG. 13 is a top view of structure 50 with piercing assembly control arm 20 in the fire position, exposing fire position warning indicator 39. As discussed in more detail in connection with FIGS. 17 and 18, the rotation of piercing assembly control arm 20 from the load position to the fire position moves movable electrode 38 from a position outside of shock tube 6, as shown in FIG. 17, and causes movable electrode 38 to pierce the side of shock tube 6 so as to penetrate shock tube 6 to a position proximal to adjustable electrode 32, forming spark gap G, as shown in FIG. 18.

Figure 14:
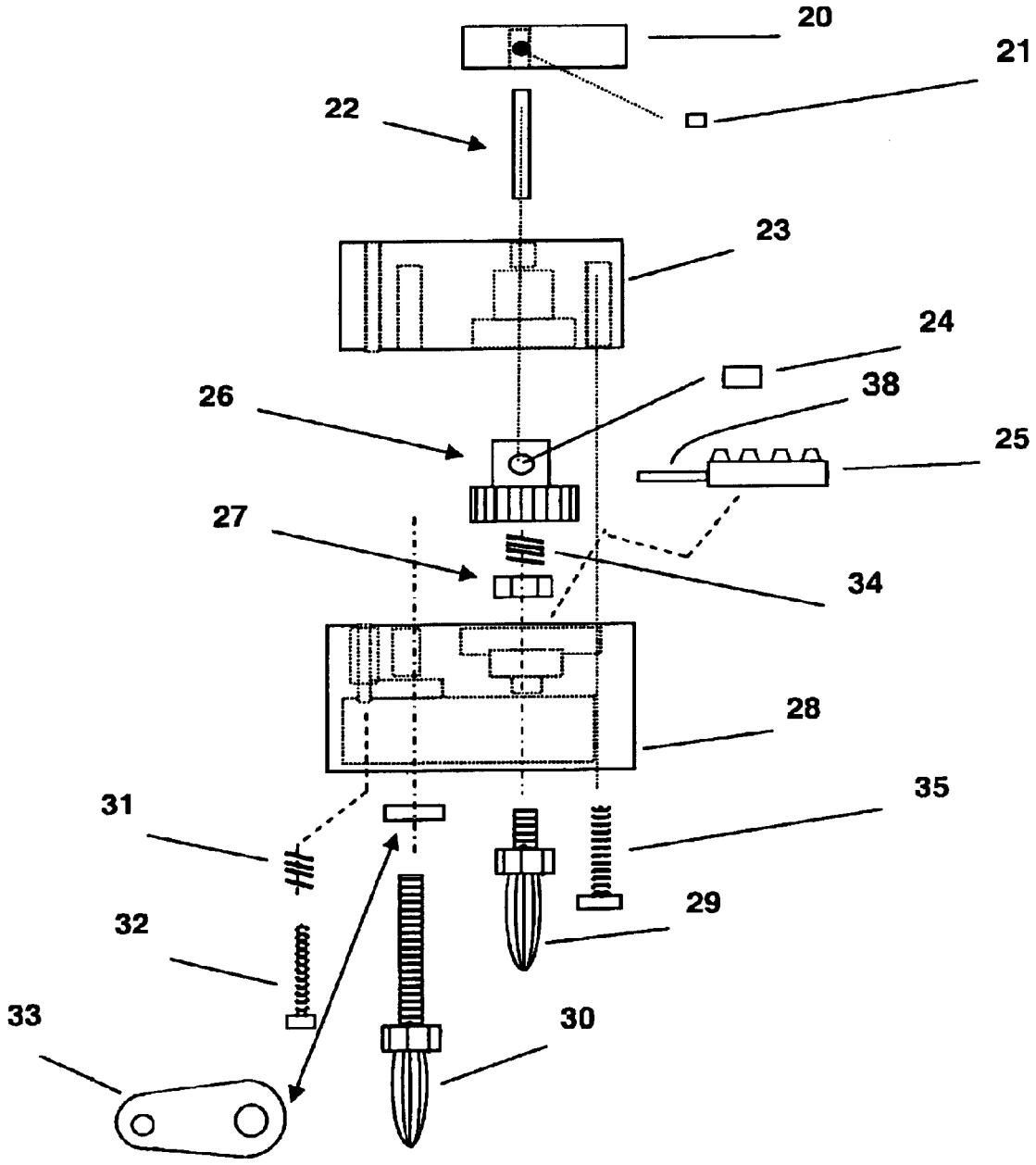
FIG. 14 is an exploded view of the embodiment of the present invention shown in FIG. 10 showing the various parts of the invention.
Figure 15:
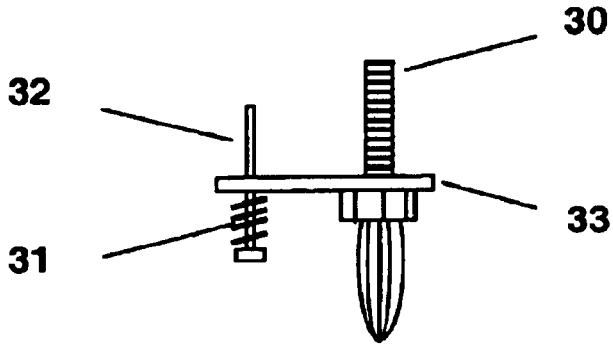
FIG. 15 is a side detail view of the adjustable electrode, spring, current path connecting link, and banana plug assembly of the embodiment of the present invention shown in FIG. 10.
Figure 16:
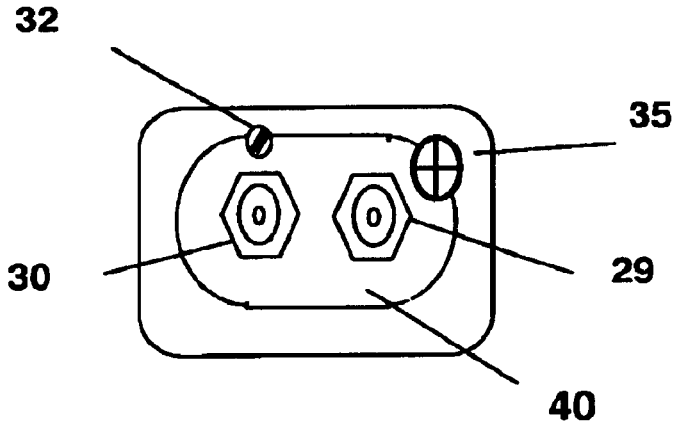
FIG. 16 is a bottom view of the embodiment of the present invention shown in FIG. 10.

FIG. 14 is an exploded side schematic view of the component parts of a preferred embodiment of the invention showing the structural and proximal relationship of the various components to each other. FIG. 15 is a side detail schematic view of adjustable electrode 32, post adjustment retention spring 31, high current connecting link 33, and second banana post/retention screw connection 30. FIG. 16 is a bottom detail schematic view of the invention showing second banana plug/retention screw connection 30, adjustable electrode 32, rear retention screw 35, first banana plug/screw assembly 29, and high voltage shroud 40.

Figure 17:
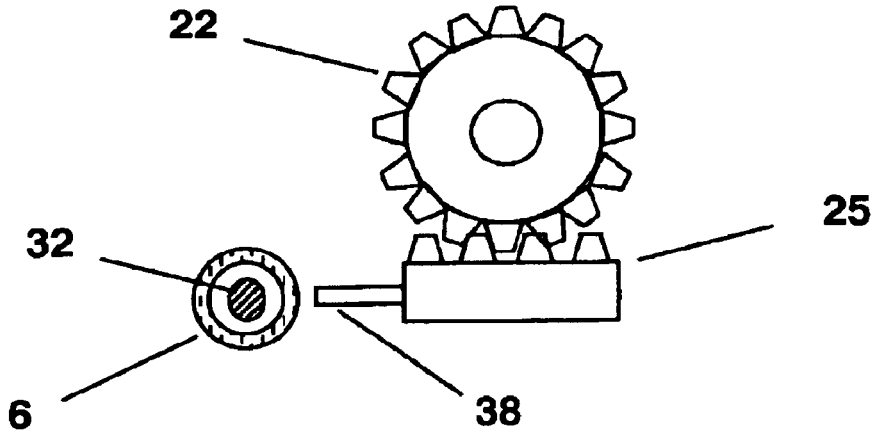
FIG. 17 is a top view of the pinion gear and rack piercing assembly of the embodiment of the present invention shown in FIG. 10.
Figure 18:
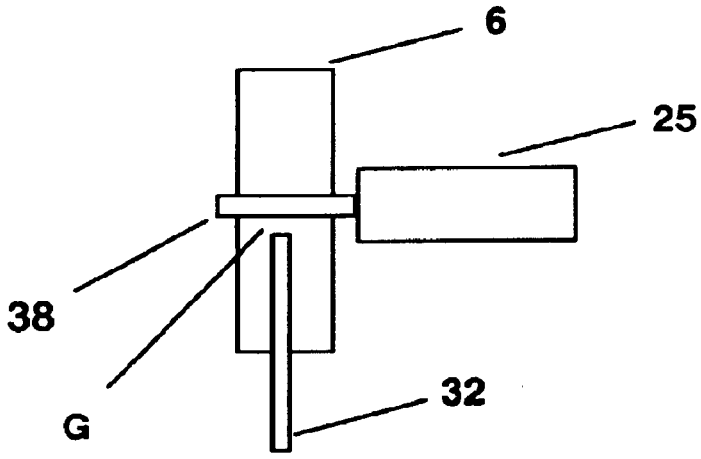
FIG. 18 is a schematic sectional side view of the rack piercing assembly, adjustable electrode, and shock tube of the embodiment of the present invention shown in FIG. 10.

FIG. 17 is a top detail schematic view of piercing assembly 25 with movable electrode 38, and pinion drive gear 22 that is attached to control arm 20. A cross-section of shock tube 6, loaded onto adjustable electrode 32 also is shown. FIG. 18 is a side detail schematic view of piercing assembly 25 with movable electrode 38 penetrating a shock tube 6 segment with adjustable electrode 32 inserted into shock tube 6 through an end.

The preferred embodiment of the invention uses independent electrodes 32, 38 that enter non-electric shock tube 6 at a non-coaxial and preferably perpendicular angle to achieve a spark gap G inside of non-electric shock tube 6 and that are encased in a polymeric housing structure 50. The overall design is optimized for vertical integration; that is, shock tube 6 is inserted vertically into structure 50. As electrodes 32, 38 do not use a coaxial design, the invention does not require an insulator in the vicinity of the plasma electrodes arc (the spark) to provide a separation between electrodes 32, 38. The typical wear out mechanism of the coaxial initiator is removed from the design, thus insuring an improved longevity of the initiator tip.

FIG. 14 shows the main components of the invention. Shaft 22 extends through upper housing 23 and connects control arm 20 to pinion drive gear 26. Roll pin 21 secures control arm 20 to shaft 22 and setscrew 24 secures pinion drive gear to shaft 22. First banana plug connection 29 is secured to lower housing 28 by lock nut 27 and provides electric current to pinion drive gear 26 by spring interface conductor 34. These components act as a perpendicular piercing conductor assembly, as shown in FIGS. 17 and 18. The shaft 22 motion is facilitated by control arm 20.

Adjustable electrode 32, which enters the hollow interior of shock tube 6 and forms spark gap G in conjunction with the rack piercing assembly 25, has a post adjustment tensioning spring 31 that doubles as a current path for conductor interface link 33. Conductor interface link 33 is held in place by the second banana plug screw assembly connection 30, which serves both as a retention fastener for holding upper housing 23 and lower housing 28 together and as a current path for adjustable electrode 32. Adjustable electrode 32 can have a screw-type structure allowing adjustable electrode 32 to be raised or lowered within structure 50, thus allowing an adjustable insertion depth within shock tube 6. Screw 35 serves as a secondary retention fastener for holding upper housing 23 and lower housing 28 together.

Movable electrode 38 is attached to or a part of rack piercing assembly 25. Rack piercing assembly 25 has a gear component that cooperates with pinion drive gear 26. When control arm 20 is rotated from the load position to the fire position, shaft 22 is rotated, rotating pinion drive gear 26. Pinion drive gear 26 then interacts and cooperates with the gear component of rack piercing assembly 25, causing rack piercing assembly to move sideways, urging movable electrode 38 towards and piercing into shock tube 6. When control arm 20 is rotated from the fire position to the load position, this process is reversed, withdrawing movable electrode 38 from shock tube 6.

FIG. 16 illustrates high voltage shroud 38 that protects the operator from high voltage, adjustable electrode 32, rear retention screw 35, and front retention banana plug connection 30.

Referring now to FIGS. 10–18, an exemplary description of how the use of the device will be given. The device is attached to an electric source (not shown) with the control arm 20 in the retracted or disarmed or safety position. As shown more specifically in FIG. 10, shock tube 6 is inserted into insertion port 36 in upper housing 23 of structure 50 and pressed down on an electrode, typically second or adjustable electrode 32. Adjustable electrode 32 enters shock tube 6 from the end of shock tube 6, that is adjustable electrode 32 and shock tube 6 preferably are coaxial to each other.

Control arm 20, which is connected to rack piercing assembly 25, which in turn comprises first or movable electrode 38, is moved from the retracted or disarmed or safety position as shown more specifically in FIG. 12 to the inserted or armed or firing position as shown more specifically in FIG. 13. This movement, as illustrated in FIG. 17, causes movable electrode 38 to pierce the side of shock tube 6, as illustrated in FIG. 18. Movable electrode 38 in this example enters shock tube 6 perpendicular to both the axis of shock tube 6 and adjustable electrode 32, creating a spark gap G between electrodes 32, 38.

Once control arm 20 has been moved to the inserted or armed or firing position, electric current is sent through the electrodes 32, 38, causing a spark in spark gap G between electrodes 32, 38. This spark causes the ignition of shock tube 6. After shock tube 6 has been ignited and used, it can be removed from insertion port 36 and another shock tube 6 substituted, and the device used again. It is contemplated that the device can be used many times with less wear that associated with the prior art, making the present invention more economical and more efficient, as well as easier and more convenient to use.

As shown in the other figures, such as FIGS. 5–9, the above description is illustrative only, and it is contemplated that other configurations of electrodes can be used. All such structures, and their equivalents, are covered by the present invention, which is the use of non-coaxial electrodes penetrating into a shock tube.

In the second preferred embodiment shown in FIG. 5, opposing electrodes 7, 8 can be inserted in a piercing manner into shock tube 6. Either or both electrodes 7, 8 can be connected to rack piercing assemblies 25. In the third preferred embodiment shown in FIG. 6, shock tube 6 is urged against razor wheel electrodes 9, 10. For example, razor wheel electrodes 9, 10 can be located on either side of insertion port 36 such that when shock tube 6 is inserted into insertion port, the sides of shock tube 6 contact and are penetrated (by cutting) by razor wheel electrodes 9, 10. Similarly, in the fourth preferred embodiment shown in FIG. 7, tertiary electrode 11 can substitute for adjustable electrode 32, and razor wheel electrodes 11, 12 act in the same manner of razor wheel electrodes 9, 10. In this embodiment, the use of tertiary electrode 11 helps ensure a suitable spark.

In the fifth preferred embodiment shown in FIG. 8, parallel or slightly converging electrodes 14, 15 are contained in an insulating block 16. The combination of electrodes 14, 15 and insulating block 16 can substitute for adjustable electrode 32. Similarly, in the sixth preferred embodiment shown in FIG. 9, electrodes 18, 19 are attached to ceramic rod 17. The combination of electrodes 18, 19 and ceramic rod 17 can substitute for adjustable electrode 32.

The above description and examples set forth the best mode of the invention as known to the inventor at this time, and is for illustrative purposes only, as one skilled in the art will be able to make modifications to this process without departing from the spirit and scope of the invention and its equivalents as set forth in the appended provisional claims.

What is claimed is:

1. An initiator tip device for igniting a shock tube comprising:

a. a first electrode for inserting into the shock tube at a first location;

b. a second electrode for inserting into the shock tube at a second location;

c. means for inserting at least one of the electrodes into the shock tube; and d. means for delivering an electric charge to one of the electrodes, wherein a spark gap is created between the electrodes such that when the electric charge is delivered a spark is created within the spark gap thus igniting the shock tube.

2. The device as claimed in claim 1, wherein the first electrode and the second electrode are in a non-coaxial configuration.

3. The device as claimed in claim 1, wherein the spark gap is internal to the shock tube.

4. The device as claimed in claim 1, wherein the means for inserting at least one of the electrodes into the shock tube comprises a simple machine selected from the group consisting of lever, inclined plane, screw, cam, gears, or combinations thereof.

5. The device as claimed in claim 4, wherein the means for inserting at least one of the electrodes into the shock tube further provides for the reversible movement of one of the electrodes between a retracted position outside of the shock tube and an inserted position inside of the shock tube.

6. The device as claimed in claim 1, further comprising an electrode holder for holding the first electrode and the second electrode and wherein the electrode holder is a polymeric material selected to provide stability and insulation for the electrodes.

7. The device as claimed in claim 6, wherein the electrode holder further comprises a guide for positioning the shock tube in relation to the electrodes.

8. The device as claimed in claim 6, wherein the electrode holder further comprises a means for releasable connecting the electrode holder to and from an electrical source.

9. The device as claimed in claim 3, wherein the electrodes are positioned internal to the shock tube.

10. The device as claimed in claim 2, wherein there is no insulation between and separating the first electrode and the second electrode.

11. The device as claimed in claim 1, wherein the electrodes are adjustable.

12. The device as claimed in claim 6, wherein the means for inserting provides a piercing action into the shock tube so as to provide a positive retention of the shock tube within the electrode holder.

13. The device as claimed in claim 1, wherein the first electrode and the second electrode are in a right angle configuration.

14. The device as claimed in claim 4, further comprising a control arm for moving the means for inserting from the retracted position to the inserted position and back.

15. The device as claimed in claim 14, further comprising a means for indicating the safety status position of the control arm to warn the user that the device is armed or disarmed.

16. The device as claimed in claim 1, wherein the electrodes are high voltage electrodes.

17. The device as claimed in claim 6, wherein the electrode holder further comprises a lower shroud that forms a high voltage protection shield to prevent the user from contacting high voltage elements of the device.

18. The device as claimed in claim 15, wherein the control arm further comprises a positive mechanical stop at the retracted position and at the inserted position.

19. The device as claimed in claim 4, wherein the means for inserting comprises gears moving in a gear path from the retracted position to the inserted position and back.

20. The device as claimed in claim 19, wherein the first electrode is a piercing electrode comprising a self adjusting contact spring.

21. The device as claimed in claim 1, wherein the second electrode comprises a spring-loaded contact to allow for its adjustment relative to the shock tube.

22. The device as claimed in claim 21, wherein the second electrode comprises a spring-loaded contact to prevent post adjustment movement of the second electrode.

23. The device as claimed in claim 21, wherein the second electrode comprises a spring that insures a stable current path.

24. The device as claimed in claim 6, wherein the electrode holder further comprises a visual inspection port to allow the user to observe when loading the shock tube into the device.

25. The device as claimed in claim 6, wherein the electrode holder further comprises a visual inspection port to allow the user to observe the electrodes when calibrating the gap between the electrodes.

26. The device as claimed in claim 6, wherein the electrode holder further comprises an exhaust port to allow discharge of gases from the shock tube during firing.

27. An initiator tip device for igniting a shock tube comprising:

a. a first electrode for inserting into the shock tube at a first location;

b. a second electrode for inserting into the shock tube at a second location; and c. means for delivering an electric charge to one of the electrodes, wherein a spark gap internal to the shock tube is created between the electrodes such that when the electric charge is delivered a spark is created within the spark gap thus igniting the shock tube.

28. The device as claimed in claim 27, wherein the first electrode and the second electrode are in a non-coaxial configuration.

29. The device as claimed in claim 27, further comprising a means for inserting the second electrode into the shock tube.

30. The device as claimed in claim 29, wherein the means for inserting comprises a simple machine selected from the group consisting of lever, inclined plane, screw, cam, gears, or combinations thereof.

31. The device as claimed in claim 30, wherein the means for inserting at least one of the electrodes into the shock tube further provides for the reversible movement of one of the electrodes between a retracted position outside of the shock tube and an inserted position inside of the shock tube.

32. The device as claimed in claim 27, further comprising an electrode holder for holding the first electrode and the second electrode and wherein the electrode holder is a polymeric material selected to provide stability and insulation for the electrodes.

33. The device as claimed in claim 32, wherein the electrode holder further comprises a guide for positioning the shock tube in relation to the electrodes.

34. The device as claimed in claim 32, wherein the electrode holder further comprises a means for releasable connecting the electrode holder to and from an electrical source.

35. The device as claimed in claim 27, wherein the electrodes are adjustable.

36. The device as claimed in claim 31, wherein the means for inserting provides a piercing action into the shock tube so as to provide a positive retention of the shock tube within the electrode holder.

37. The device as claimed in claim 27, wherein the first electrode and the second electrode are in a right angle configuration.

38. The device as claimed in claim 31, further comprising a control arm for moving the means for inserting from the retracted position to the inserted position and back.

39. The device as claimed in claim 38, further comprising a means for indicating the safety status position of the control arm to warn the user that the device is armed or disarmed.

40. The device as claimed in claim 27, wherein the electrodes are high voltage electrodes.

41. The device as claimed in claim 31, wherein the electrode holder further comprises a visual inspection port to allow the user to observe when loading the shock tube into the device.

42. The device as claimed in claim 31, wherein the electrode holder further comprises a visual inspection port to allow the user to observe the electrodes when calibrating the gap between the electrodes.

43. The device as claimed in claim 31, wherein the electrode holder further comprises an exhaust port to allow discharge of gases from the shock tube during firing.

44. The device as claimed in claim 35, wherein the first electrode is self-adjusting.

45. The device as claimed in claim 35, wherein the second electrode is self-adjusting.

46. The device as claimed in claim 35, wherein the first electrode and the second electrode are self-adjusting.

47. An initiator tip device for igniting a shock tube comprising:

a. a first electrode for inserting into the shock tube at a first location;

b. a second electrode for inserting into the shock tube at a second location;

c. means for inserting the second electrode into the shock tube;

d. means for delivering an electric charge to one of the electrodes; and e. an electrode holder for holding the first electrode and the second electrode, wherein a spark gap internal to the shock tube is created between the electrodes such that when the electric charge is delivered a spark is created within the spark gap thus igniting the shock tube, and wherein the first electrode and the second electrode are in a non-coaxial configuration.

48. The device as claimed in claim 47, wherein the means for inserting comprises a simple machine selected from the group consisting of lever, inclined plane, screw, cam, gears, or combinations thereof that provides for the reversible movement of the second electrode between a retracted position outside of the shock tube and an inserted position inside of the shock tube.

49. The device as claimed in claim 48, wherein the electrode holder further comprises a guide for positioning the shock tube in relation to the electrodes.

50. The device as claimed in claim 49, wherein the electrode holder further comprises a means for releasable connecting the electrode holder to and from an electrical source.

51. The device as claimed in claim 47, wherein the electrodes are adjustable.

52. The device as claimed in claim 47, wherein the means for inserting provides a piercing action into the shock tube so as to provide a positive retention of the shock tube within the electrode holder.

53. The device as claimed in claim 47, wherein the first electrode and the second electrode are in a right angle configuration.

54. The device as claimed in claim 48, further comprising a control arm for moving the means for inserting from the retracted position to the inserted position and back.

55. The device as claimed in claim 47, wherein the electrodes are high voltage electrodes.

56. The device as claimed in claim 47, wherein the electrode holder further comprises a visual inspection port to allow the user to observe when loading the shock tube into the device.

57. The device as claimed in claim 47, wherein the electrode holder further comprises a visual inspection port to allow the user to observe the electrodes when calibrating the gap between the electrodes.

58. The device as claimed in claim 47, wherein the electrode holder further comprises an exhaust port to allow discharge of gases from the shock tube during firing.

59. The device as claimed in claim 47, wherein the first electrode is self-adjusting.

60. The device as claimed in claim 47, wherein the second electrode is self-adjusting.

61. The device as claimed in claim 47, wherein the first electrode and the second electrode are self-adjusting.

* * * * *